United States Patent [19]

Fish et al.

[11] Patent Number: 4,941,334

[45] Date of Patent: Jul. 17, 1990

[54] DOOR LOCKING ARRANGEMENT

[75] Inventors: Aaron M. Fish, Hampstead; Hariharan Somasundaram, Ville St. Laurent, both of Canada

[73] Assignee: Ilco Unican Inc., Montreal, Canada

[21] Appl. No.: 304,247

[22] Filed: Jan. 31, 1989

[51] Int. Cl.[5] ..... E05B 43/00

[52] U.S. Cl. ..... 70/214; 70/269; 292/139

[58] Field of Search ..... 70/133, 134, 149, 156, 70/214, 219, 220, 223, 267–269, 271, 422; 292/169.17, 169.21, 139, 336.5

[56] References Cited

U.S. PATENT DOCUMENTS

| | | | |
|---|---|---|---|
| 766,253 | 8/1904 | Howe | 292/139 |
| 2,991,643 | 7/1961 | Hitt | 292/139 X |
| 3,702,549 | 11/1972 | Solovieff et al. | 292/139 X |
| 3,702,551 | 11/1972 | Blizard | 70/269 |
| 3,747,377 | 7/1973 | Van Deudekom | 70/149 |
| 4,601,499 | 7/1986 | Kim | 292/139 X |
| 4,640110 | 2/1987 | Fish et al. | 70/269 |
| 4,773,240 | 9/1988 | Foshee | 70/422 X |

*Primary Examiner*—Gary L. Smith
*Assistant Examiner*—Suzanne L. Dino
*Attorney, Agent, or Firm*—Fleit, Jacobson, Cohn, Price, Holman & Stern

[57] ABSTRACT

A clutch system for use in the door locking arrangement has a drive member. A latch acutating member and a permutation lock reset member are disposed on either side of the drive member. The drive member is operatively connected to the actuating means, for example a door knob or a lever handle, so that the drive member drives the latch actuating member, to retract the latch member of the door locking arrangement, when a correct combination has been inserted into the permutation lock of the door locking arrangement. When an incorrect combination has been inserted, the drive member drives the permutation lock reset member to reset the permutation lock. A linkage operatively connects both the latch operating member and the permutation lock reset member to the control shaft of the permutation lock. The linkage serves to operatively connect the control shaft to the actuating means either through the drive member and the latch actuating member when the correct combination has been inserted, or through the drive member and permutation lock resetting member when an incorrect combination has been inserted. The linkage is symmetrically disposed so that only minor modifications are required to adapt the arrangement from an actuating means which rotates in a counter-clockwise direction to an actuating means which rotates in a clockwise direction.

5 Claims, 2 Drawing Sheets

DOOR LOCKING ARRANGEMENT

BACKGROUND OF INVENTION

1. Field of the Invention

The invention relates to a door locking arrangement which includes a permutation lock having a control shaft extending therefrom and an actuating means, such as a lever handle or door knob, for effecting retraction of a latch member, and link means for interfering with such retraction on actuation of the actuating means when an incorrect combination is inserted into the permutation lock, the link means being operatively connected to both the actuating means and the control shaft More specifically, the invention relates to such an arrangement having a symmetrical link means.

2. Description of Prior Art

One such arrangement is illustrated in U.S. Pat. No. 3,747,377, Van Deudekom, July 24, 1973. The patented arrangement includes a clutch system having a latch operating disc 37 which is operatively connected to control shaft 18 of permutation lock 14 through a linkage system 73, and a knob disc 38 which is operatively connected to the actuator means (door knob 12) through a system of shafts and sleeves. Because of the lack of symmetry of the patented arrangement, it is adapted to be coupled to a door knob which rotates in one direction only. If the arrangement is to be coupled to a door knob which rotates in the opposite direction, then substantial modifications must be made tot he arrangement.

U.S. Pat. No. 4,640,110, Fish et al, Feb. 3, 1987, teaches an arrangement similar to the arrangement taught in U.S. Pat. No. 3,747,377 but which additionally includes an automatic delay relocking device. The latter patented arrangement has the same lack of symmetry as the arrangement of the former patent.

SUMMARY OF INVENTION

It is therefore an object of the invention to provide a door locking arrangement of the type above-described which overcomes a disadvantage of the above-described arrangement.

It is a more specific object of the invention to provide a door locking arrangement of the type above-described which includes symmetrical link means.

In accordance with the invention there is provided a door locking arrangement which includes a permutation lock having a control shaft extending therefrom and an actuating means for effecting retraction of a latch member. The arrangement includes a clutch system having a drive member, a latch actuating member, and a permutation lock reset member. The latch actuating member and the permutation lock reset member are disposed on either side of the drive member. The drive member is operatively connected to the actuating means. Thus, the drive member drives the latch actuating member, to retract the latch member, when a correct combination has been inserted in the permutation lock. The drive member drives the permutation lock reset member, to reset the permutation lock, when an incorrect combination has been inserted into the permutation lock. Link means operatively connect both the latch actuating member and the permutation lock reset member to the control shaft. Thus, the link means operatively connects the control shaft to the actuating means either through the latch actuating member and the drive member when the correct combination has been inserted in the permutation lock, or through the permutation lock resetting member and the drive member when an incorrect combination has been inserted in the permutation lock. The link means are symmetrically

BRIEF DESCRIPTION OF DRAWINGS

The invention will be better understood by an examination of the following description, together with the accompanying drawings, in which.

DESCRIPTION OF PREFERRED EMBODIMENTS

Figure 1:
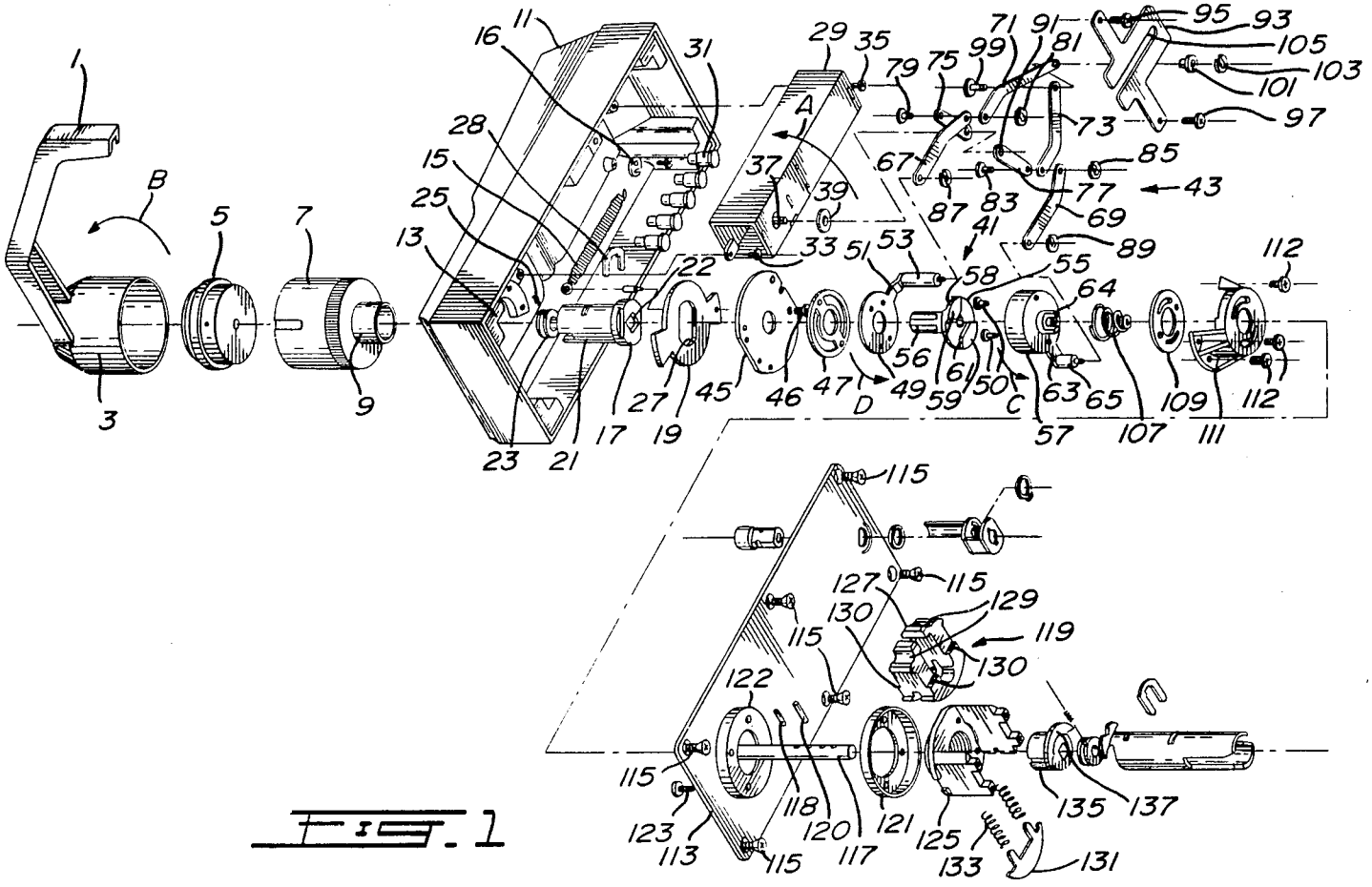
FIG. 1 is an exploded view of the inventive arrangement.

Referring to FIG. 1, the inventive arrangement includes an actuator, in this case, comprising an outside lever handle 1. The lever handle 1 includes a receptacle 3 in which is mounted a cover adaptor 5. Handle cylinder 7, which includes sleeve 9, is fitted over the cover adaptor which is disposed in the receptacle 3.

Housing 11 has an opening 13 through which cylinder 7 and sleeve 9 extend.

Inside the housing, lever return spring 15 is mounted on spring hook 16 and is connected to stop plate 19 by pin 17 for reasons to be below discussed.

Outside sleeve 21 extends into sleeve 9 and carries within it outside handle retainer plug 23 which, together with handle retainer spring 25 retain the actuating means mounted on the housing 11. The stop plate 9 includes an opening 27 which is of the same shape as the rear end of outside sleeve 21. Thus, the stop plate 19 will rotate with outside sleeve 21 when the stop plate is mounted on the rear end of the outside sleeve 21. As the outside sleeve 21 is connected for rotation with cylinder 7, and as cylinder 7 is connected for rotation with the outside lever handle 1, stop plate 19 will rotate with the rotation of the outside lever handle. When sleeve 9 rotates, :t will stretch lever return spring 15, so that when the outside lever handle 1 is released, it will be returned to its original position by the action of the lever return spring 15 on stop plate 19. It is noted that retainer 28 will project through aperture 9A of sleeve 9 to retain cover adapter 5 and lever handle 1 in position. The clutch backing plate 45 will overlie stop plate 19 and keep it in place.

Also mounted in the housing 11 is permutation lock chamber 29 which includes push-buttons 31. The push-buttons will extend out of the front of the housing 11 so that they are accessible to a user. Permutation lock chamber 29 is mounted in housing 11 by screws 33 and 35.

Extending out of the rear end of the permutation lock chamber is a control shaft 37. Washer 39 overlies the control shaft 37.

The arrangement further includes a clutch system, indicated generally at 41, and a link means, indicated generally at 43. The clutch system rests on a clutch backing plate 45 and includes a permutation lock reset member spring 47. The clutch itself comprises a permutation lock reset member 49 having an arm 51 which supports a roller pin 53. Pins 50 extend outwardly from reset member 49. The roller pin extends transversely of the plane of the permutation lock reset member. The clutch backing plate 45 is mounted on the housing by screws 46.

The clutch further includes a drive member 55 and a latch actuating member 57. Disposed on the rear surface of the drive member 55 are abutments 59 having ramp edges 61 at either edge thereof. Similar abutments are disposed on the inner surface of the latch actuating member (not seen in the drawings), and the abutments of the drive member 55 engage, or slip over, the abutments of the latch actuating member 57 in the same manner as described and illustrated in the above-mentioned U.S. Pat. No. 3,747,337.

Non-circular sleeve 56 of drive member 55 is inserted into matching opening 22 of outside sleeve 21 so that sleeve 56, and therefore drive member 55, will rotate with the rotation of outside sleeve 21, and therefore with the rotation of outside lever handle 1.

Latch actuating member 57 also includes an arm 63 which is, in the rest position, substantially 180 degrees removed from the arm 51. Arm 63 supports roller pin 65 which is disposed at right angles to the arm 63.

The link means 43 consist of drive links 67 and 69, transfer links 71 and 73, dummy link 75 and control shaft link 77. Pin 79 extends through openings in the top end of link 67, the inner end of dummy link 75 and the bottom end of transfer link 71. The pin is retained in the openings by clip 81. With pin 79 and clip 81 mounted in the link means, link 67, link 71 and link 75 are pivotable relative to each other.

In the same way, pin 83 extends through openings in the inner end of control shaft link 77, drive link 69 and transfer link 73, and is held in place by clip 85 such that links 69, 73 and 77 are pivotable relative to each other.

Roller pin 53 extends through an opening in the bottom end of drive link 67, and the drive link is maintained pivotable about the roller pin 53 by clip 87. In the same way, arm 65 extends through an opening in the bottom end of link 69 and link 69 is maintained on the roller pin pivotable relative thereto by clip 89.

Shaft 37 extends through openings in the outer end of dummy link 75 and control shaft link 77. As can be seen, opening 91 at the outer end of control shaft link 77 has the same shape as the cross-sectional shape of the shaft 37. Accordingly, control shaft link 77 will pivot with the rotation of the shaft 37. However, dummy link 75 pivots about shaft 37.

The arrangement also includes a clip guide bracket 93 which is mounted in the housing 11 by screws 95 and 97. Pin 99 extends through the openings in the top ends of transfer links 71 and 73, through slit 105 in guide bracket 93 and into roller guide 101 to maintain transfer links 71 and 73 pivotable to each other such that the roller guide 101 will move up and down slit 105 when the transfer )inks pivot relative to each other. Clip 103 maintains pin 99 and roller guide 101 in position.

The clutch itself further includes a latch actuating member spring 107 and a latch actuating member reinforcement plate 109. Clutch cover 111 covers the clutch and is mounted in the housing 11 by clutch cover screws 112.

Cover plate 113 covers the rear opening of the housing 11 and is mounted thereon by screws 115. Latch actuating shaft 117 extends outwardly of the cover plate at its rear end. Its front end is mounted in receptacle 64 on the rear surface of latch actuating member 57 for rotation with the latch actuating member 57.

A latch actuator mechanism, indicated generally at 119, is operatively connected to the shaft 117. The actuator mechanism includes a spacer 121 (for adjusting to different door thicknesses mounted on abutment 122 of cover plate 113 by screws 123 (only one screw is shown in the drawings). Shoe retainer 125 is mounted in the receptacle-like spacer 121, and retractor shoe 127, having arms 129 and steps 130 on both the front and rear surfaces thereon, is mounted in the shoe retainer 125. Bridge 131 mounts springs 133 which engage retractor shoe 127 to bias it outwardly (in the latch extended position). Drive sleeve 135, having an ear 137, is mounted to the front of retractor shoe 127 so that ears 137 will engage steps 130 on the front surface of retractor shoe 129 when in operation. Shaft 117 extends through drive sleeve 135 so that the drive sleeve will rotate with shaft 117. Arms 129 grasp the door latch (not shown) to retract the latch when retractor shoe 127 is moved rearwardly against the force of spring 133.

In operation, the arrangement works as follows:

Shaft 37 will be free to rotate in the counter-clockwise direction as seen from the rear of the arrangement, that is, in the direction of the arrow A, when a correct combination is inserted into permutation lock 29. At all other times, that is, when an incorrect combination is inserted, shaft 37 is free to rotate in the opposite direction, that is, in the clockwise direction as seen from the rear of the lock. When shaft 37 is rotated in the clockwise direction, the permutation lock is reset.

In the rest position, spring 107 will force latch actuating member 57 against drive member 55 so that the abutments 59 on the outer surface of drive member 55 will be in engagement with the abutments on the inner surface of latch actuating member 57. Thus, latch actuating member 57 will rotate with rotation of drive member 55. When the clutch slips, because latch actuating member 57 is held against rotation, then ramps 61 will cam with similar ramps of the abutments on the inner surface of latch actuating member 57 to force latch actuating member 57 frontwardly. When this happens, reset member 49 will move outwardly engaging pins 50 into depression 58 on the front surface of drive member 55 so that permutation lock reset member 49 will rotate with drive member 55.

Figure 2A:
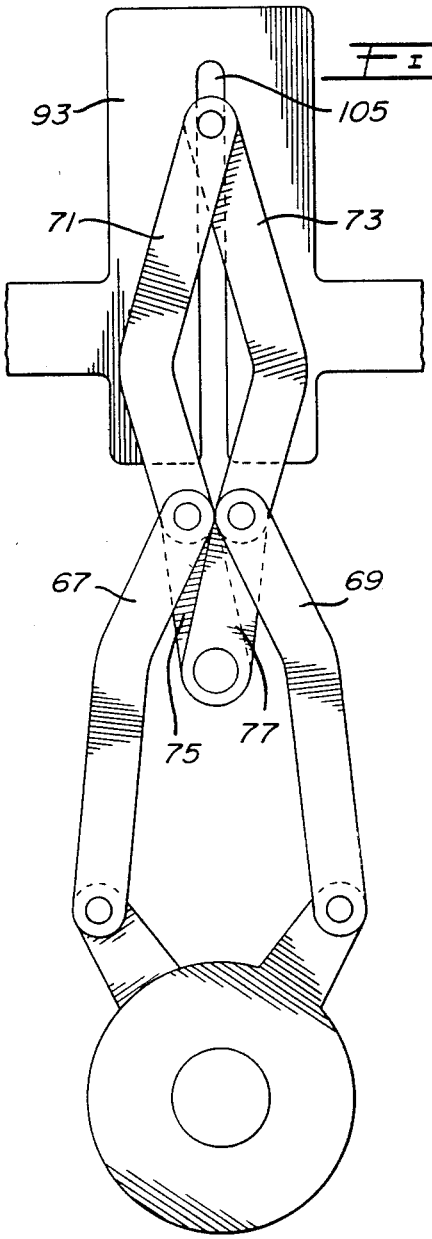
FIG. 2A is a rear view of the assembled arrangement with the cover plate removed, showing the arrangement of the link means when a correct combination has been inserted in the permutation lock and the actuating means has been actuated.

Referring now to FIGS. 1 and 2A of the drawings, we will consider first the case when a proper combination has been inserted into the permutation lock 29. When outside lever handle 1 is then rotated in a counter-clockwise direction as seen from the rear of the arrangement (in the direction of arrow B—the only direction in which the outside lever handle 1 can be rotated in the case of a right-hand lock), drive member 55 will rotate in the same direction. As the clutch is engaged, latch actuating member 57 will also rotate in the same direction ( in the direction of arrow B) to cause drive link 69 to move upwardly. This will cause control shaft link 77 to also pivot in a counter-clockwise direction as seen from the rear of the arrangement and, as control shaft link 77 is connected for rotation with control shaft 37, the control shaft will be driven in the counter-clockwise direction. As a proper combination has been inserted, it is possible for control shaft 37 to rotate in this direction so that control shaft link 77 can pivot counter-clockwise and transfer link 73 will also move upwardly taking with it transfer link 71. Transfer link 71 will also cause dummy link 75 and drive link 69 to move upwardly so that, when the handle has been fully rotated, the link means will assume the position as shown in FIG. 2A.

At the same time, rotation of latch actuating member 57 will cause rotation of shaft 117 through roll pin 118 which, in turn, will cause rotation of drive sleeve 135 through roll pin 120. When drive sleeve 135 rotates, ear 137 of the drive sleeve 135 will push a step 130 of retractor shoe 127 to thereby cause the retractor shoe 127 to move rearwardly against the force of springs 133. When retractor shoe 127 moves rearwardly, it will take with it the latch (not shown) to place the latch in its retracted position.

When outside lever handle 1 is released, stop plate 19 will be returned by spring 15 so that outside sleeve 21 will rotate in the opposite (clockwise) direction causing drive member 55, latch actuating member 57 and shaft 117 to move in the same opposite clockwise direction. Thus, ear 137 will also rotate so that shoe retractor 125 will move outwardly. The latch will move back into its extended position.

Figure 2B:
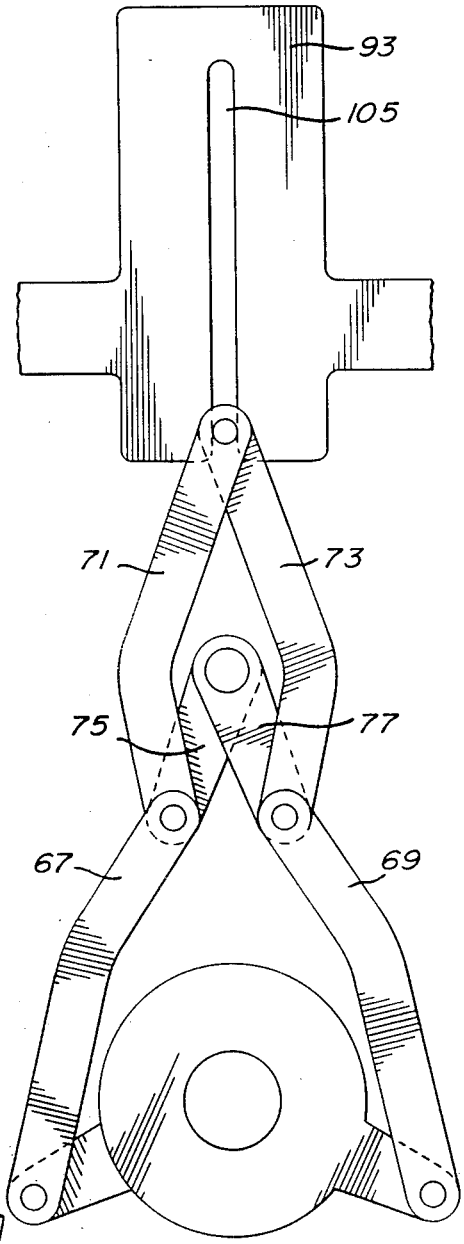
FIG. 2B is a rear view of the assembled arrangement with the cover plate removed, showing the arrangement of the link means when an incorrect combination has been inserted in the permutation lock and the actuating means has been actuated.

The case of an incorrect combination or no combination at all will now be considered in association with FIGS. 1 and 2B. When outside lever handle 1 is rotated in the direction of arrow B under these conditions, latch actuating member 57 will again attempt to rotate in the direction of arrow C to drive drive link 69 upwardly. Once again, control shaft link 75 will attempt to rotate in a counter-clockwise direction. However, as an incorrect combination was inserted into the permutation lock, shaft 37 will not be free to rotate in the counter-clockwise direction. Accordingly, latch actuating member 57 will be held against rotation under the latter conditions so that the clutch will slip and drive member 55 will engage with permutation lock reset member 49. Permutation lock reset member 49 will now rotate in a counter-clockwise direction (in the direction of arrow D) and will pull down drive link 67. Transfer link 71 will follow drive link 67 in the downward direction, and take with it transfer link 73 which in turn will force drive link 69 in a downward direction. The downward movement of transfer link 73 and drive link 69 will cause control shaft link 77 to pivot in a clockwise direction and to thereby rotate shaft 37 in the same clockwise direction. The rotation of the shaft 37 will reset permutation lock 29. When the handle has been fully rotated, the link means will be positioned as illustrated in FIG. 2B.

In the latter case, latch actuating member 57 will rotate in a clockwise direction. The shaft 117 will remain stationary because of the lazy cam action between sleeve 64 and roll pin 118 installed in shaft 117. Accordingly, the retractor shoe will not be forced backwardly and the latch will not be retracted.

Thus, when the outside lever handle 1 is rotated with an improper combination inserted into the permutation lock 29, the latch will not be retracted, but the permutation lock 29 will be reset.

If it is desired to utilize the arrangement with an actuator which rotates in the clockwise direction (i.e. outside lever handle is rotated through an angle of 180 degrees—with the illustrated embodiment, the locking means would be mounted on the righthand side of a door—with the clockwise turning arrangement, it would be mounted on the left-hand side of the door), it is merely necessary to rotate both permutation lock reset member 49 and latch actuating member 57 through 180 degrees so that the arms 51 and 63 respectively will be on opposite sides. Drive shaft 117 is rotated through 90 degrees and pin 120 engages in a horizontal slot of drive sleeve 135. (It engages in a vertical slot with a right-hand handle.) Drive link 67 would now be connected to roller pin 65, and drive link 69 would be connected to roller pin 53.

When the actuator is now rotated in the clockwise direction, latch actuating member 57 will rotate in a clockwise direction lifting drive link 67 upwardly. Drive link 67 will in turn push transfer link 71 upwardly, and transfer link 73 will follow transfer link 71 in an upward direction. This will, once again, cause control shaft link 77 to pivot in a counter-clockwise direction and, with the proper combination having been inserted into permutation lock 29, link 77 will not be prevented from rotation in this direction.

Drive sleeve 135 will also rotate in a clockwise direction so that the right-hand ear will engage appropriate step 130 to drive retractor shoe 127 backwardly and to thereby place the latch in its retracted position Accordingly, it can be seen that only minor modifications are needed to adapt the arrangement from operation with a counter-clockwise turning actuator to operation with a clockwise turning actuator Although only one embodiment has been described, this was for the purpose of illustrating, but not limiting, the invention. Various modifications, which will come readily to the mind of one skilled in the art, are within the scope of the invention as defined in the appended claims

We claim:

1. A door locking arrangement including a permutation lock having a control shaft extending therefrom, and an actuating means for effecting retraction of a latch member, and comprising:

a clutch system having a drive member, a latch actuating member and a permutation lock reset member, said latch actuating member and said permutation lock reset member being disposed on either side of said drive member;

said drive member being operatively connected to said actuating means to rotate therewith;

wherein, said drive member drives said latch actuating member, to retract said latch member, when a correct combination has been inserted in said permutation lock; and said drive member drives said permutation lock reset member to reset said permutation lock, when either an incorrect combination, or no combination at all, has been inserted in said permutation lock;

link means operatively connecting both said latch actuating member and said permutation lock reset member to said control shaft;

whereby, said link means operatively connects said actuating means to said control shaft either through said drive member and said latch actuating member when the correct combination has been inserted into said permutation lock, or through said drive member and said permutation lock resetting member when an incorrect combination has been inserted in said permutation lock;

said link means being symmetrically disposed;

said link means comprising:

a first drive link pivotally connected, at one end thereof, to said permutation lock reset member;

a second drive link pivotally connected, at one end thereof, to said latch actuating member;

a first transfer link pivotally connected, at one end thereof, to the other end of said first drive link;

a second transfer link pivotally connected, at one end thereof, to the other end of said second drive link;

the other end of said first transfer link being pivotally connected to the other end of said second transfer link;

a dummy link pivotally connected, at one end thereof, to both said first drive link, at the other end thereof, and said first transfer link, at the one end thereof, the other end of said dummy link being pivotally mounted on said control shaft for pivoting thereabout;

a control shaft link pivotally connected, at one end thereof, to said second drive link at the other end thereof, and said second transfer link, at the one end thereof, the other end of said control shaft link being fixedly coupled to said control shaft such that said control shaft link will pivot with rotation of said control shaft.

2. An arrangement as defined in claim 1 wherein said actuating means rotates in a counter-clockwise direction when seen from the rear of the arrangement, and wherein said control shaft is rotatable in a counter-clockwise direction, as seen from the rear of the arrangement, when the correct permutation has been inserted, and is rotatable in a clockwise direction to reset the permutation lock when an incorrect combination has been inserted into the permutation lock.

3. An arrangement as defined in claim 2 and further including a latch actuator shaft, said latch actuator shaft being operatively connected, at one end thereof, to said latch actuating member to rotate therewith;

the other end of said latch actuator shaft being connected to a latch retracting mechanism.

4. An arrangement as defined in claim 1 wherein said actuating means is rotatable in a clockwise direction when seen from the rear of the arrangement and said control shaft is rotatable in a counter-clockwise direction, as seen from the rear of the arrangement, when a correct permutation has been inserted in said permutation lock, and wherein said control shaft is rotatable in a clockwise direction when an incorrect combination has been inserted in said permutation lock to reset said permutation lock.

5. An arrangement as defined in claim 4 and further including a latch actuator shaft, said latch actuator shaft being operatively connected, at one end thereof, to said latch actuating member to rotate therewith;

the other end of said latch actuator shaft being connected to a latch retracting mechanism

* * * * *